US005092370A

United States Patent [19]

Anderson

[11] Patent Number: 5,092,370

[45] Date of Patent: Mar. 3, 1992

[54] SPLIT HEDDLE WITH SUPERIMPOSED BLADES WITH ALIGNED APERTURES

[75] Inventor: Larry D. Anderson, Appleton, Wis.

[73] Assignee: Asten Group, Inc., Charleston, S.C.

[21] Appl. No.: 671,351

[22] Filed: Mar. 19, 1991

Related U.S. Application Data

[63] Continuation of Ser. No. 472,720, Jan. 31, 1990, Pat. No. 5,005,608.

[51] Int. Cl.[5] ..... D03C 9/02

[52] U.S. Cl. ..... 139/93

[58] Field of Search ..... 139/383 AA, 35, 93, 139/94, 95, 96, 51, 52, 53, 355, 356, 357; 28/198, 205, 206, 207, 201, 202, 203 R, 203 A, 208, 209

[56] References Cited

U.S. PATENT DOCUMENTS

| | | | |
|---|---|---|---|
| 880,215 | 2/1908 | Hiller . | |
| 1,079,470 | 11/1913 | Colman . | |
| 1,082,474 | 12/1913 | Colman . | |
| 1,107,345 | 8/1914 | Pickard | 139/95 |
| 1,245,418 | 11/1917 | Alford . | |
| 1,341,244 | 5/1920 | Ruegg | 139/93 |
| 1,779,312 | 3/1928 | Hammer . | |
| 2,011,115 | 8/1935 | Peterson . | |
| 2,039,157 | 4/1936 | Fleischer . | |
| 2,249,390 | 7/1941 | Mahler | 139/93 |
| 2,385,703 | 9/1945 | Heiber . | |
| 2,449,691 | 10/1947 | Deal . | |
| 2,523,932 | 5/1949 | Abbott . | |
| 2,786,256 | 3/1957 | Axelsson . | |
| 2,800,927 | 12/1952 | Silberman et al. . | |
| 2,845,686 | 8/1958 | Mason . | |
| 2,863,492 | 7/1955 | Chang et al. . | |
| 3,885,596 | 5/1975 | Alexeff . | |
| 3,962,762 | 6/1976 | Alexeff . | |
| 3,974,551 | 8/1976 | Baer et al. . | |
| 3,990,732 | 11/1976 | Reichert . | |
| 4,152,815 | 6/1979 | Altenweger . | |
| 4,175,307 | 11/1979 | Altenweger . | |
| 4,194,538 | 3/1980 | Borodin et al. . | |
| 4,410,015 | 10/1983 | Koller et al. . | |
| 4,506,707 | 3/1985 | Shimizu | 139/91 |
| 4,581,794 | 1/1989 | Oldroyd et al. . | |

OTHER PUBLICATIONS

Publication by Samuel Dracup and Sons Ltd., Lane Close Mills, Great Horton, no date supplied.

*Primary Examiner*—Andrew M. Falik
*Attorney, Agent, or Firm*—Volpe & Koenig

[57] ABSTRACT

A split heddle for controlling a yarn is particularly useful in automated seaming machines. The heddle is comprised of two blade like members. Each member has an aperture which is intersected on one side by a slot and on the other side by a groove. The members are superimposed with the apertures in alignment and the grooves opposite the slots. The unit is secured by laser, spot or sonic welding. After insertion of the yarn(s) in the aperture, the heddle is rotated 180° with respect to the yarn(s) and the yarn(s) is/are captured in the channel formed by the opposed grooves.

11 Claims, 1 Drawing Sheet

SPLIT HEDDLE WITH SUPERIMPOSED BLADES WITH ALIGNED APERTURES

This is a Continuation of application Ser. No. 07/472,720, filed Jan. 31, 1990 U.S. Pat. No. 5,005,608.

BACKGROUND OF THE INVENTION

1. Field of the Invention

The present invention relates generally to heddles for use in weaving and more particularly to split heddles for use in connection with automated seaming of flat woven fabrics. In particular, the present invention finds use in automatic seaming equipment which utilizes a Jacquard Machine in the shed formation process.

2. Description of the Prior Art

For some time, the art has recognized the advantages to be gained from split heddles. One prior art split heddle used for automatic seaming is comprised of two stainless steel strips which are secured about a stainless steel spacing washer. The two stainless steel strips and the spacing washer are bonded together in a sandwich like arrangement. The assembly of this prior art heddle requires that great care be taken in the positioning and bonding of the individual pieces. Misalignment of the various pieces cannot be tolerated. In addition to problems with misalignment, the prior art device is not tolerant of any curvature in the metal strips. Curvature in the metal strips caused an opening in the washer area and this opening frequently resulted in a failure to retain the strand within the heddle. Although the prior art device was frequently used, the above factors contributed to a high cost of construction, a high rate of rejection during manufacturing of the heddles and high maintenance during weaving.

It is the purpose of the present invention to provide a heddle which eliminates the need for a spacing washer, improves the tolerance of the heddle for curvature in the metal strips and reduces maintenance.

SUMMARY OF THE INVENTION

The heddle is comprised of two superimposed blades. Each blade has an aperture in communication with a slot and an arcuate groove or channel. The blades are superimposed and bonded with the grooves facing in opposite directions and extending through the slot in the opposing blade. The apertures and the opposed grooves define a yarn passage or channel in the heddle.

BRIEF DESCRIPTION OF THE DRAWINGS

FIG. 7 represents the zero position; FIG. 8 represents 90° of rotation; and FIG. 9 represents 180° of rotation.

DETAILED DESCRIPTION OF THE PREFERRED EMBODIMENT

The preferred embodiment will be described with reference to the drawings and like elements are identified by the same numeral throughout.

Figure 1:
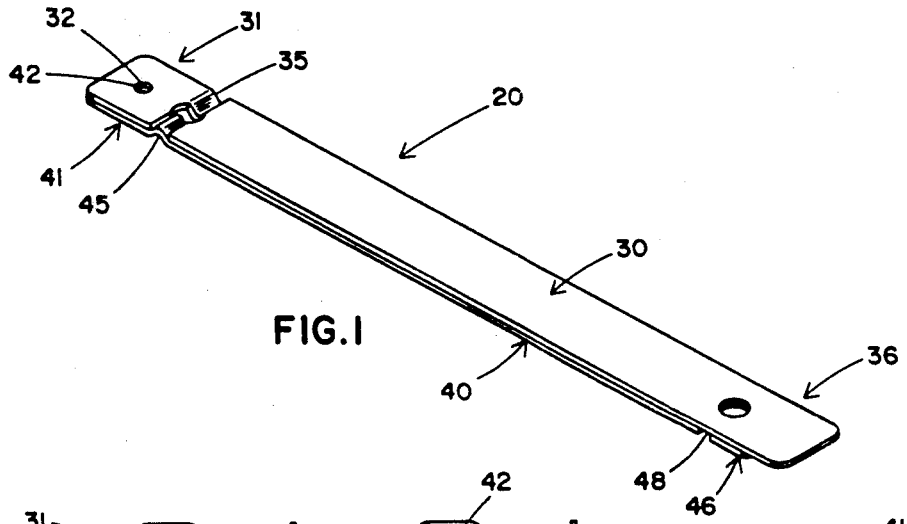
FIG. 1 is a perspective view of the heddle in accordance with the present invention.

With reference to FIG. 1, the split heddle 20 of the present invention is comprised of two blade or strip members 30 and 40 which are bonded together at their respective ends 31 and 41. The blades 30 and 40 may be of the same or different length. In the preferred embodiment, blade 30 is slightly longer than blade 40. In the preferred embodiment, the blade 30 has an overall length, from end to end, of approximately 5.5 inches and the blade 40 has an overall end to end length of approximately 5.375 inches.

As noted previously with respect to FIG. 1, the heddle 20 is comprised of individual elongate blade members or strips, 30 and 40, which have been superimposed, aligned and bonded. Each blade has an aperture, 32 or 42 , through its first end, 31 or 41. While it is preferable that the apertures 32 and 42 be in direct alignment, this is not critical to the invention. The respective heddle members 30 and 40 need only be in sufficient alignment to permit the oppositely facing arcuate grooves or channel portions 35 and 45 to be in sufficient alignment for a channel to be formed across the heddle. The reason for this alignment will become more evident upon reading the description hereinafter.

The preferred material for blades 30 and 40 is stainless steel. The preferred method of bonding is laser welding, however, spot-welding and sonic welding are alternative bonding methods.

In order to more fully understand the invention, each blade 30 and 40, will be described individually. For this purpose, reference will be made to FIGS. 2 through 5.

Figure 2:
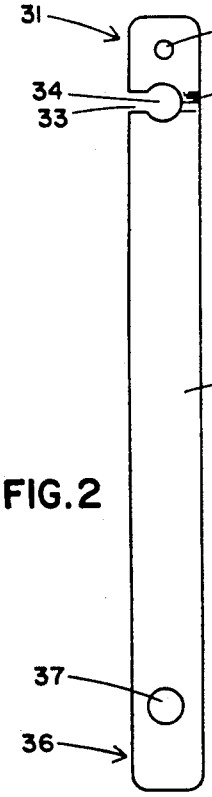
FIG. 2 is a front elevation of a first heddle strip in accordance with the heddle of the present invention.

Referring first to FIG. 2, strip 30 has a first end 31 having two apertures 32 and 34 which are generally on the longitudinal centerline. Aperture 32 has a diameter of approximately 0.065 inches. Aperture 34 has a diameter of approximately 0.128 inches. The aperture 34 is intersected on one side by a horizontal slot 33 which extends through to the edge of the blade member 30. Slot 33 has a width of approximately, 0.078 inches. The aperture 34 is also in communication with the arcuate groove or channel portion 35. The groove 35 is on the centerline with the slot 33 and the aperture 34. This may be seen clearly with reference to FIG. 2. Groove 35 is concave with respect to the plane of the blade 30 as shown in FIG. 2; this is evident from FIG. 3. Groove 35 has a radius of approximately 0.009 inches. The blade 30 has an overall average thickness of approximately 0.018 inches with the thickness at the groove 35, as illustrated by the numeral 38 in FIG. 3, being approximately 0.054 inches.

The blade 40 will be described with reference to FIGS. 4 and 5. The first end 41 of blade 40 is essentially a mirror image of end 31 of blade 30. All of the elements of end 41 correspond with the like element of end 31. However, it should be noted with respect to the groove 45, that it will be convex with respect to the plane of the blade 40. This may be clearly seen with reference to FIG. 1. Blade 40 differs from blade 30 as described hereinafter. As stated previously, the overall length of blade 40 is approximately 0.125 inches less than that of blade 30. This may be seen with reference to FIG. 6. The aperture 47 in end 46 of blade 40 will be positioned opposite the aperture 37. Aperture 47 is intersected by horizontal slot 48 which extends through the end 46. Slot 48 is approximately 0.040 inches wide. The differential length is believed to make it easier to separate and move the blades during yarn insertion.

Figure 3:
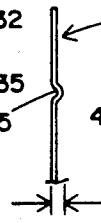
FIG. 3 is a fragmentary side elevation of the heddle strip of FIG. 2.
Figure 4:
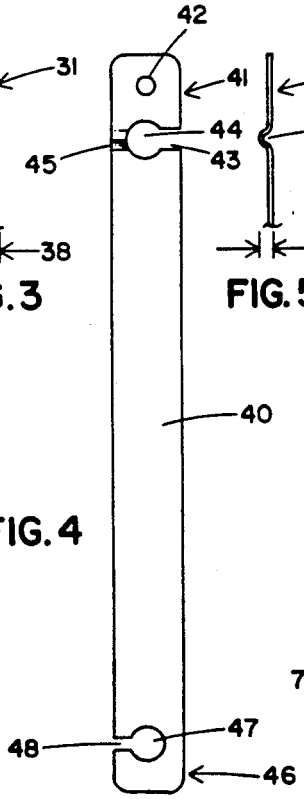
FIG. 4 is a front elevation of a second heddle strip in accordance with the heddle of the present invention.
Figure 5:
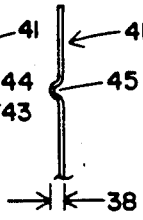
FIG. 5 is a side elevation of the heddle strip of FIG. 4.
Figure 10:
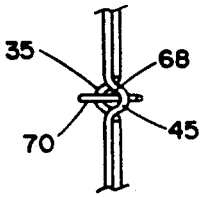
FIG. 10 is a fragmentary section illustrating the position of a yarn as it is placed in the heddle.
Figure 11:
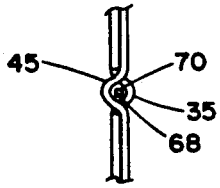
FIG. 11 illustrates the capture of the yarn in the heddle channel after a 180° rotation from the position depicted in FIG. 10.

With reference to FIG. 1, it can be seen that the grooves 35 and 45 are facing in opposite directions and they cooperate to effectively close the apertures 34 and 44, FIGS. 3 and 4 and define a horizontal channel 68 across the heddle 20, FIGS. 10 and 11. Groove 35 fits through slot 43 and groove 45 fits through slot 33. As a result of their convex-concave configurations the grooves 35 and 45 each form one half of the horizontal channel 68 across the heddle. Channel 68 has a diameter of approximately 0.033 inches but may be dimensioned to accommodate the yarns that are to be controlled.

Figure 6:
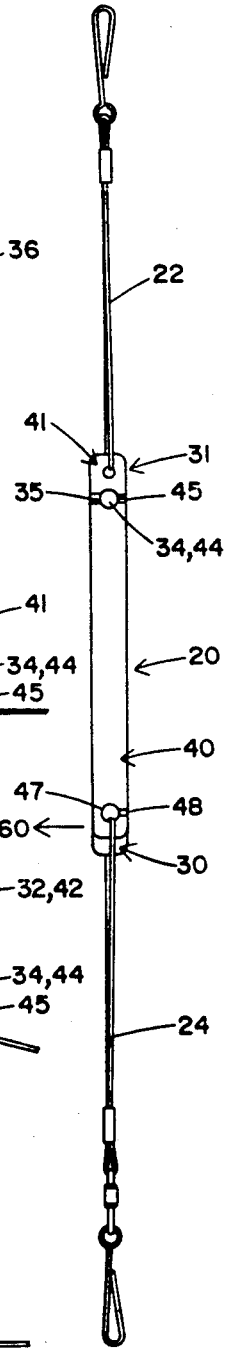
FIG. 6 is a front elevation of the heddle strip of FIG. 1 rotated 180° and assembled with heddle leads.
Figure 7:
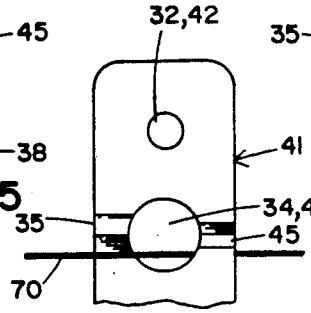
FIGS. 7, 8 and 9 illustrate the use and rotation of the present heddle as shown in FIG. 6.
Figure 8:
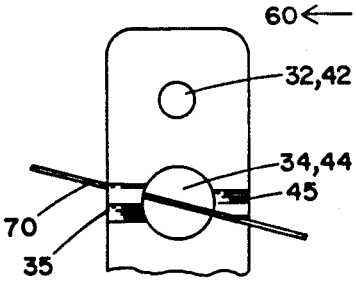
Figure 9:
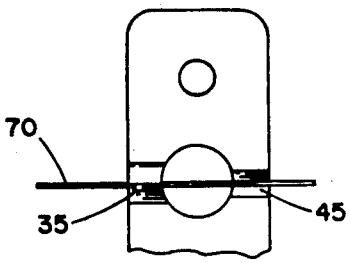

With reference to FIG. 6, the heddle 20 is assembled with lead lines 22 and 24. The two blade members 30 and 40 are assembled together, such as by sonic or spot welding at the respective ends 31 and 41. The lead line 22 passes through apertures 32 and 42. The lead line 24 passes through apertures 37 and 47. As known by those skilled in the art, the lead lines 22 and 24 provide a means of controlling the heddle during weaving. Other control means may be used. Due to the existence of slot 48 in the end 46, blade 40 may be separated from blade 30 and moved to the side, as indicated by arrow 60, by passing lead 24 through the slot 48. This movement of blade 40 provides a separation between the blades 30 and 40 so that a yarn may be passed between the blades and into the apertures 34 and 44. This positioning of a yarn 70 in the apertures 34 and 44 is shown in FIG. 7. At this point in time, the yarn 70 extends over groove 35 which is convex with respect to the frontal plane of the figure and behind groove 45 which is concave with respect to the frontal plane of the figure. After a rotation of approximately 90°, the yarn 70 will be within the apertures 34 and 44, see FIG. 8. By continuing the rotation through 180°, the yarn 70 will be positioned so that it now extends in a straight line and rests within the cross channel 68 formed by the opposed grooves 35 and 45, see FIG. 9. At this point in time, the yarn 70 is captured by the heddle and will be retained in that position regardless of slight variations or curvatures in members 30 and 40 and/or slight variations with respect to precise alignment of the ends 31 and 41 and/or the arcuate portions 35 and 45.

FIG. 10 illustrates the position of yarn 70 relative to channel 68 prior to rotation and FIG. 11 illustrates the position of yarn 70 in the channel 68 after rotation through 180°.

If desired, the second blade may be shorter and the aperture 47 and the slot 48 may be eliminated. Since there is virtually no space between the blade members 30 and 40, they will be in very close contact. Since the channel 68 is closed, a yarn will not slip between the blades 30 and 40, even if the lead line 24 does not pass through the aperture 47.

As can be seen from the foregoing, a simplified heddle construction with improved yarn control reliability has been disclosed.

What I claim is:

1. A heddle comprised of two blade members, each having an aperture intersected by oppositely facing slot and groove portions, said blade members being superimposed with their apertures aligned to form with said groove and slot portions, a yarn passage therethrough as a result of their securedly superimposed position.

2. The heddle of claim 1 wherein the blade members are stainless steel.

3. The heddle of claim 1 wherein the blade members are secured together by laser welding.

4. A heddle comprising:

a first blade member having a first aperture at a first end thereof, a second aperture at a second end thereof, and a selectively configured yarn guiding portion proximate said first aperture;

a second blade member having a first aperture at a first end thereof, a second aperture at a second end thereof, a selectively configured yarn guiding portion proximate said first aperture, and a slot in communication with the second aperture;

said first apertures allowing the attachment of a first heddle control means to the first and second members;

said second apertures allowing the attachment of a second heddle control means to the first and second members; and said slot permitting disengagement of said second blade member from said second control means so that a yarn may pass between the two blade members.

5. The heddle of claim 4 wherein the yarn guiding portions are in communication with each other such that the yarn may enter into the area defined by the yarn guiding portion and said yarn will be retained by the yarn guiding portion when the heddle is axially rotated 180°.

6. The heddle of claim 5 wherein the yarn guiding portion of the second member is a mirror image of the yarn guiding portion of the first member, and said yarn guiding portions define a channel.

7. The heddle of claim 4 wherein the yarn guiding portion consists of a perpendicular slot extending past the center of the members and on the opposite side thereof a channel portion.

8. The heddle of claim 4 wherein the first and second members are stainless steel.

9. The heddle of claim 4 wherein the heddle control means are lead lines.

10. A method for threading a heddle comprising:

providing a split heddle with two superimposed blades having aligned slots and channel portions, one end of said heddle being attached to a first controls means, the opposite end of said heddle being attached to a second controls means, detaching one end of one blade from one of the control means to permit a yarn to be inserted between the two blades;

sliding a yarn between the blades into the slots; and reattaching said one blade end.

11. A method according to claim 10, further comprising axially rotating the heddle substantially 180° after the yarn is slid between the blades into the slots so that the yarn is retained by the channel portions.

* * * * *